US007963626B2

(12) United States Patent
Umeda

(10) Patent No.: US 7,963,626 B2
(45) Date of Patent: Jun. 21, 2011

(54) LIQUID-DROPLET EJECTING APPARATUS

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 604 days.

(21) Appl. No.: 12/135,134

(22) Filed: Jun. 6, 2008

(65) Prior Publication Data

US 2008/0303848 A1 Dec. 11, 2008

(30) Foreign Application Priority Data

Jun. 7, 2007 (JP) ..... 2007-151782

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS

| | | | | |
|---|---|---|---|---|
| 4,977,413 | A | 12/1990 | Yamanaka et al. | |
| 5,729,256 | A | 3/1998 | Yamanaka et al. | |
| 6,619,776 | B2 | 9/2003 | Yoshiyama et al. | |
| 6,916,076 | B2 | 7/2005 | Yoshiyama et al. | |
| 2005/0007401 | A1 | 1/2005 | Katayama | |
| 2006/0038862 | A1 * | 2/2006 | Tanno | 347/84 |
| 2006/0244799 | A1 * | 11/2006 | Sasa et al. | 347/89 |

FOREIGN PATENT DOCUMENTS

| | | | |
|---|---|---|---|
| JP | H63-257645 | A | 10/1988 |
| JP | 3075286 | B2 | 8/2000 |
| JP | 2003-063027 | A | 3/2003 |
| JP | 2003-063028 | A | 3/2003 |
| JP | 2004-009491 | A | 1/2004 |
| JP | 2005-041216 | A | 2/2005 |

* cited by examiner

*Primary Examiner* — Matthew Luu
*Assistant Examiner* — Justin Seo
(74) *Attorney, Agent, or Firm* — Baker Botts L.L.P.

(57) ABSTRACT

A liquid-droplet ejecting apparatus, including: a main tank which stores liquid; a head unit including a sub tank which accommodates the liquid supplied from the main tank, and an ejecting head which ejects droplets of the liquid supplied from the sub tank; a liquid supply passage communicating, at one end thereof, with the main tank and communicating, at the other end thereof, with the sub tank such that the liquid is supplied from the main tank to the sub tank through the liquid supply passage; a first detector configured to detect presence and absence of the liquid stored in the main tank; a second detector configured to detect presence and absence of the liquid in the liquid supply passage; and a controller configured to perform various operations for the liquid-droplet ejecting apparatus and including an empty judging section which judges that the main tank is empty of the liquid where the absence of the liquid in the main tank is detected by the first detector and the absence of the liquid in the liquid supply passage is detected by the second detector.

12 Claims, 7 Drawing Sheets

| FIRST INK DETECTOR (INK IN INK CARTRIDGE) / SECOND INK DETECTOR (INK IN MAIN-TANK-SIDE CONNECTING PORTION) | DETECTING PRESENCE OF INK (INTERCEPTING PLATE HAS INTERCEPTED LIGHT EMITTED FROM LIGHT-EMITTING DEVICE) | DETECTING ABSENCE OF INK (LIGHT-RECEIVING DEVICE HAS RECEIVED LIGHT EMITTED FROM LIGHT-EMITTING DEVICE) |
|---|---|---|
| DETECTING PRESENCE OF INK (RESISTANCE VALUE BETWEEN ELECTRODES IS EQUAL TO OR SMALLER THAN THRESHOLD VALUE) | SUFFICIENT AMOUNT OF INK IS IN INK CARTRIDGE | INK CARTRIDGE IS NEAR EMPTY |
| DETECTING ABSENCE OF INK (RESISTANCE VALUE BETWEEN ELECTRODES IS LARGER THAN THRESHOLD VALUE) | INK-JET PRINTER HAS MALFUNCTION | INK CARTRIDGE IS EMPTY (DISPLAYING MESSAGE FOR PROMPTING USER TO REPLACE INK CARTRIDGE) |

UP
DOWN
SHEET FEEDING DIRECTION
RESISTANCE-VALUE DETECTING CIRCUIT
POWER SOURCE
100
110
120
121
122
122A
122B
122C
130
131
132
133
140
150
151
152
153
153A
154
155
160
161
162
163
164
165
166
168
170
180
181
182
200
204

FIG.7

| FIRST INK DETECTOR (INK IN INK CARTRIDGE) / SECOND INK DETECTOR (INK IN MAIN-TANK-SIDE CONNECTING PORTION) | DETECTING PRESENCE OF INK (INTERCEPTING PLATE HAS INTERCEPTED LIGHT EMITTED FROM LIGHT-EMITTING DEVICE) | DETECTING ABSENCE OF INK (LIGHT-RECEIVING DEVICE HAS RECEIVED LIGHT EMITTED FROM LIGHT-EMITTING DEVICE) |
|---|---|---|
| DETECTING PRESENCE OF INK (RESISTANCE VALUE BETWEEN ELECTRODES IS EQUAL TO OR SMALLER THAN THRESHOLD VALUE) | SUFFICIENT AMOUNT OF INK IS IN INK CARTRIDGE | INK CARTRIDGE IS NEAR EMPTY |
| DETECTING ABSENCE OF INK (RESISTANCE VALUE BETWEEN ELECTRODES IS LARGER THAN THRESHOLD VALUE) | INK-JET PRINTER HAS MALFUNCTION | INK CARTRIDGE IS EMPTY (DISPLAYING MESSAGE FOR PROMPTING USER TO REPLACE INK CARTRIDGE) |

LIQUID-DROPLET EJECTING APPARATUS

CROSS REFERENCE TO RELATED APPLICATION

The present application claims priority from Japanese Patent Application No. 2007-151782, which was filed on Jun. 7, 2007, the disclosure of which is herein incorporated by reference in its entirety.

BACKGROUND OF THE INVENTION

1. Field of the Invention

The present invention relates to a liquid-droplet ejecting apparatus which ejects droplets of liquid. For example, the present invention is applied to an ink-jet recording apparatus (i.e., an ink-jet printer).

2. Description of the Related Art

There is conventionally known an ink-jet printer which judges a remaining amount of ink in an ink storing tank (i.e., an ink cartridge), as disclosed by Japanese Patent No. 3075286 (for example, in FIG. 1). In this ink-jet printer, two electrodes are provided in the ink cartridge to detect an electric resistance value between the two electrodes. The detected electric resistance value is always compared with a predetermined value. When the detected electric resistance value exceeds the predetermined value, the ink-jet printer outputs an advance noticing signal for informing a user that the ink cartridge is in a near-empty state. Concurrently with the output of the advance noticing signal, the ink-jet printer outputs, to a recorded-sheet-number counting circuit (i.e., a sheet-number counter), a command for starting to count a number of recorded sheets (hereinafter, may be referred to as a recorded-sheet number). When the number counted by the recorded-sheet-number counting circuit reaches a set sheet-number, up to which the ink-jet printer can perform a recording operation using the remaining ink from the detection of the near-empty state, the ink-jet printer stops the recording operation while outputting a warning signal for informing the user that the ink cartridge is empty of the ink.

SUMMARY OF THE INVENTION

However, in the above-described conventional ink-jet printer in which the warning signal is outputted on the basis of the count of the recorded-sheet number by the sheet-number counter after the advance noticing signal has been outputted on the basis of the detected electric resistance value between the electrodes, a set amount of the ink which is assumed to be consumed for the set sheet-number of the sheets does not precisely correspond to an amount of the ink which is actually consumed. Thus, the warning signal has to be outputted in a state in which a certain amount of the ink remains in the ink cartridge. This is uneconomical due to a relatively lower efficiency of using the ink.

This invention has been developed in view of the above-described situations, and it is an object of the present invention to provide a liquid-droplet ejecting apparatus in which liquid in a main tank can be almost completely used up.

The object indicated above may be achieved according to the present invention which provides a liquid-droplet ejecting apparatus, comprising: a main tank which stores liquid; a head unit including a sub tank which accommodates the liquid supplied from the main tank, and an ejecting head which ejects droplets of the liquid supplied from the sub tank; a liquid supply passage communicating, at one end thereof, with the main tank and communicating, at the other end thereof, with the sub tank such that the liquid is supplied from the main tank to the sub tank through the liquid supply passage; a first detector configured to detect presence and absence of the liquid stored in the main tank; a second detector configured to detect presence and absence of the liquid in the liquid supply passage; and a controller configured to perform various operations for the liquid-droplet ejecting apparatus and including an empty judging section which judges that the main tank is empty of the liquid where the absence of the liquid in the main tank is detected by the first detector and the absence of the liquid in the liquid supply passage is detected by the second detector.

In the liquid-droplet ejecting apparatus constructed as described above, when compared to the conventional ink-jet printer in which the empty is judged on the basis of a measured value that is detected by one sensor (i.e., the above-described detected electric resistance value between the electrodes) and a calculated value (i.e., the recorded-sheet number counted by the sheet-number counter), the presence and the absence of the liquid in the main tank can be more precisely detected. Thus, the liquid in the main tank can be almost completely used up.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIG. 7 is a judging table for explaining a criterion on which the controller 210 judges a remaining amount of the ink on the basis of a result of detections of the first ink detector 133 and the second ink detector 200.

DETAILED DESCRIPTION OF EMBODIMENTS

In the present embodiment, a liquid-droplet ejecting apparatus according to the present invention is applied to an ink-jet printer of a station supply type. Hereinafter, there will be described, by reference to the drawings, the ink-jet printer as the present embodiment according to the present invention.

The ink-jet printer, as is well known, forms an image on a recording medium such as a recording sheet by ejecting fine ink droplets onto the sheet. When forming a color image, the ink-jet printer ejects ink of various colors different from each other, e.g., cyan, magenta, yellow, and black, such that the different-color inks respectively adhere to arbitrary positions on the sheet.

Also, in the ink-jet printer of the station supply type, a main tank unit 130 and sub tanks 121 that will be described below are connected to each other when the ink is supplied to the sub tanks 121, whereas the main tank unit 130 and the sub tanks 121 are not connected to each other when the ink is not supplied to the sub tanks 121, for example, when the image is being formed.

In this ink-jet printer, when a remaining amount of the ink in the sub tanks 121 is equal to or smaller than a threshold amount, the main tank unit 130 and the sub tanks 121 are connected to each other to refill the sub tanks 121 with the ink. On the other hand, when the remaining amount of the ink in the sub tanks 121 is larger than the threshold amount, the main tank unit 130 and the sub tanks 121 are not connected to each other.

Further, this ink-jet printer has a function for detecting a presence and an absence of the ink stored in the ink cartridges 131 each as a main tank of the main tank unit 130 and for informing a user about a result of the detection.

1. Main Tank Unit

Figures 1A, 1B:
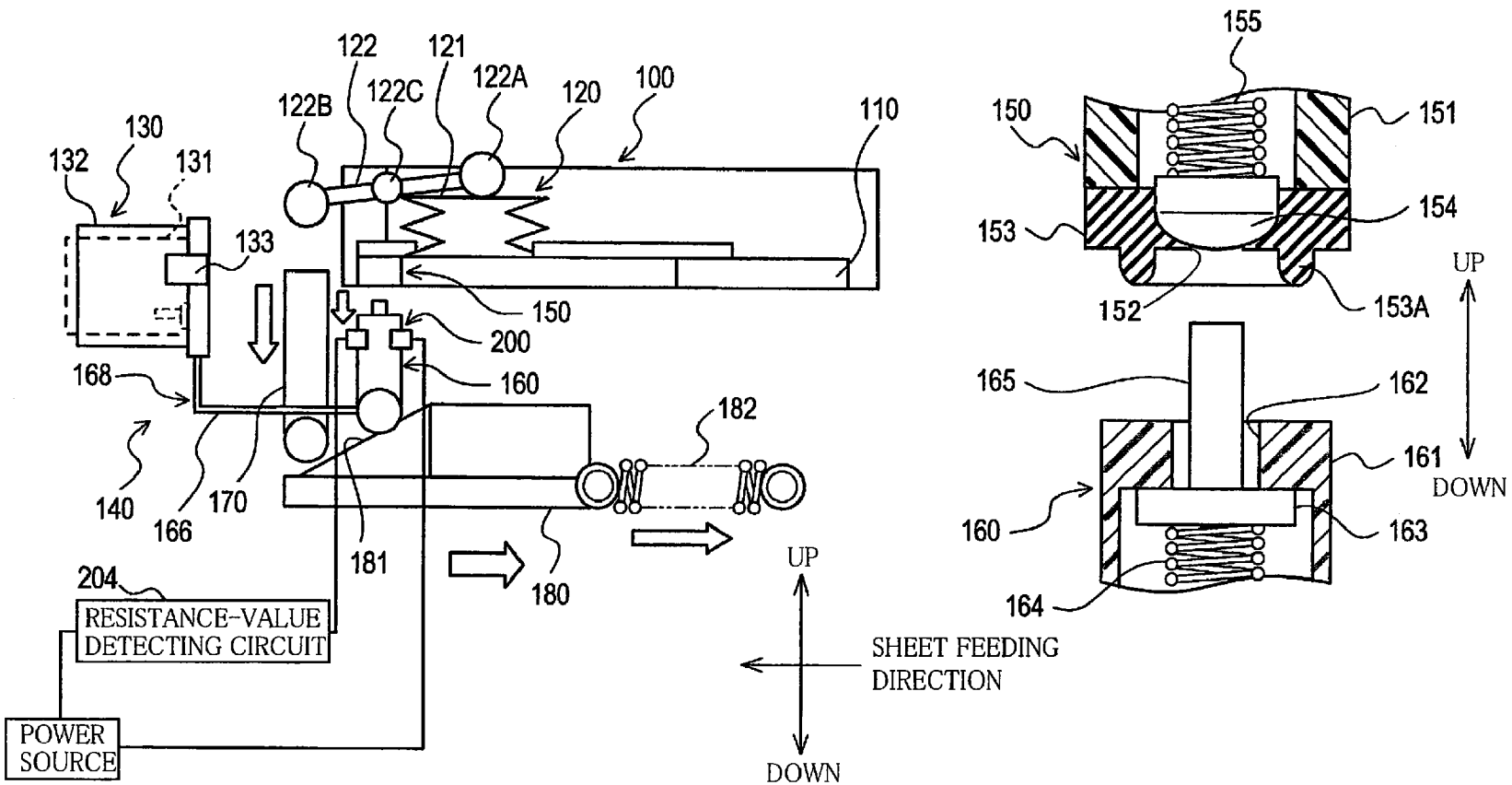
FIG. 1A is a view for explaining an ink supply mechanism when an operation of supplying ink is performed.
FIG. 1B is a view for explaining a sub-tank-side connecting portion 150 and a main-tank-side connecting portion 160 upon the operation of supplying ink.

As shown in FIG. 1A, the main tank unit 130 is constituted by a plurality of ink cartridges (main tanks) 131 each storing the ink, a cartridge casing 132 on which the ink cartridges 131 are removably mounted, and so on. It is noted that the following description will be given for one of the ink cartridges 131 for simplicity.

Figure 2:
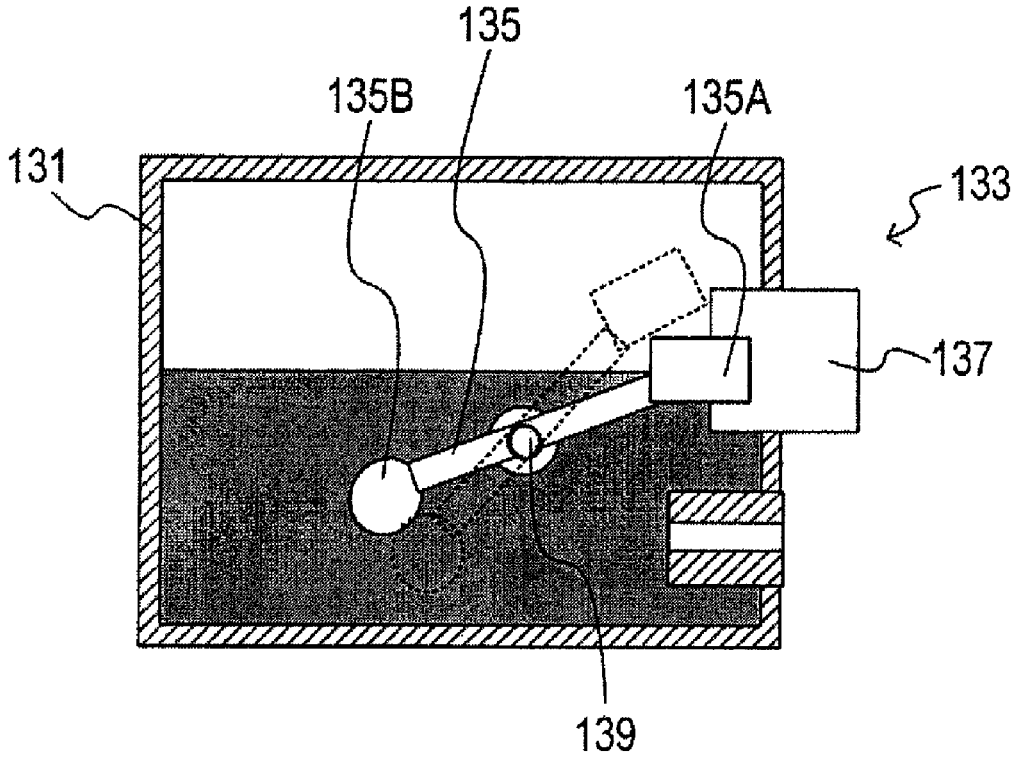
FIG. 2 is a view for explaining a configuration of a first ink detector 133.

As shown in FIG. 2, in the ink cartridge 131, there is provided an ink detecting lever 135 for detecting the presence and the absence of the ink in the ink cartridge 131. Further, an ink detecting sensor 137 that can transmit a light is provided on the cartridge casing 132 on which the ink cartridge 131 can be mounted. The ink detecting sensor 137 includes a light-emitting device (not shown) and a light-receiving device (not shown) disposed so as to be opposed to each other. The ink detecting sensor 137 detects the presence and the absence of the ink in the ink cartridge 131 by judging whether a light emitted from the light-emitting device is received by the light-receiving device. A technique of the detection of the ink detecting sensor 137 will be described below in detail. It is noted that, in FIG. 2, the cartridge casing 132 is not shown.

A first ink detector 133 as a first detector includes the ink detecting lever 135 which is rotated in accordance with the remaining amount of the ink in the ink cartridge 131, and the ink detecting sensor 137 which detects whether the ink in the ink cartridge 131 is present or absent on the basis of an amount of the rotation of the ink detecting lever 135.

The ink detecting lever 135 is provided with, at one end thereof, an intercepting plate 135A and, at the other end thereof, a floating portion 135B. Further, a pivotal shaft 139 fixed to inner sides of the ink cartridge 131 is extended through a generally intermediate portion of the ink detecting lever 135. Thus, the ink detecting lever 135 is supported so as to be pivotable about the pivotal shaft 139 in the ink cartridge 131. However, the ink detecting lever 135 is configured so as to be pivotable only between positions respectively indicated by a solid line and a broken line in FIG. 2 due to a limit of a limiting member (not shown). Where a sufficient amount of the ink is in the ink cartridge 131, the floating portion 135B of the ink detecting lever 135 tends to float or move upward to an upper side of the stored ink. Thus, the ink detecting lever 135 is in the position indicated by the solid line in FIG. 2. In this state, the intercepting plate 135A intercepts the light emitted from the light-emitting device of the ink detecting sensor 137. Thus, the light-receiving device cannot receive the light emitted from the light-emitting device. In this case, this ink-jet printer as the present embodiment recognizes that the sufficient amount of the ink is in the ink cartridge 131. On the other hand, where an amount of the ink in the ink cartridge 131 becomes relatively small, that is, the ink cartridge 131 is in a near-empty state, the floating portion 135B of the ink detecting lever 135 moves downward in the ink cartridge 131 because the floating portion 135B is heavier than the intercepting plate 135A. Thus, the ink detecting lever 135 is in the position indicated by the broken line in FIG. 2. In this state, the intercepting plate 135A does not intercept the light emitted from the light-emitting device of the ink detecting sensor 137. Thus, the light-receiving device can receive the light emitted from the light-emitting device. In this case, this ink-jet printer as the present embodiment recognizes that the ink is not in the ink cartridge 131.

2. Recording Head Unit

In FIG. 1A, a recording head unit 100 includes a sub tank unit 120 for accommodating the ink supplied from the ink cartridge 131, a recording head 110 for ejecting, onto the sheet, the droplets of the ink supplied from the sub tank unit 120, a carriage (not shown) on which the recording head 110, the sub tank unit 120, and so on are mounted, and so on. When the image is being formed, this recording head unit 100 is reciprocated in a direction that is perpendicular to a sheet feeding direction in which the sheet is fed and that is parallel to a surface of the sheet on which the image is to be recorded. That is, the recording head unit 100 is reciprocated in a main scanning direction that is perpendicular to the sheet surface of FIG. 1A.

It is noted that a plurality of nozzles (not shown) through which the ink is ejected are formed for each of the colors in one of faces of the recording head 110 which faces a fed sheet. These nozzles are arranged in a row or rows for each color in a direction parallel to the sheet feeding direction.

The sub tank unit 120 includes a plurality of the sub tanks 121 arranged in the main scanning direction and pressing levers 122 for pressing the respective sub tanks 121. Also, the sub tanks 121 can be elastically deformed so as to be extended and contracted in a direction perpendicular to the sheet feeding direction and the main scanning direction (in this ink-jet printer, in a vertical direction). Specifically, as shown in FIG. 1A, a peripheral wall of each of the sub tanks 121 has a bellows shape.

Further, as shown in FIG. 1A, described for one of the pressing levers 122 for simplicity, the pressing lever 122, as a lever member, is pivotably engaged at its one end 122A with an upper end portion of the sub tank 121. On the other hand, the other end 122B of the pressing lever 122 extends to an outside of the recording head unit 100. At a supported portion 122C between the one end 122A and the other end 122B in a longitudinal direction of the pressing lever 122, the pressing lever 122 is supported so as to be pivotable. It is noted that the supported portion 122C is pivotably attached to a main body of the recording head unit 100.

3. Ink Supply Mechanisms of Station Supply Type

3-1. General Structure of Ink Supply Mechanisms of Station Supply Type

As shown in FIG. 1A, the ink-jet printer includes ink supply mechanisms 140 of a station supply type. Each of the ink supply mechanisms 140, as a liquid supplying mechanism, includes a sub-tank-side connecting portion 150, a main-tank-side connecting portion 160, a push rod 170 for pushing a corresponding one of the other ends 122B of the pressing levers 122, a slide cam 180 for actuating a corresponding one of the main-tank-side connecting portions 160 and a corresponding one of the push rods 170, and so on.

It is noted that the sub-tank-side connecting portions 150, the main-tank-side connecting portions 160, the push rods 170, the slide cams 180, and so on are provided for the respective sub tanks 121, and the ink supply mechanisms 140 including these components have the same structure. Thus, the following description will be given, taking one of the ink supply mechanisms 140 as an example.

Figure 4B:
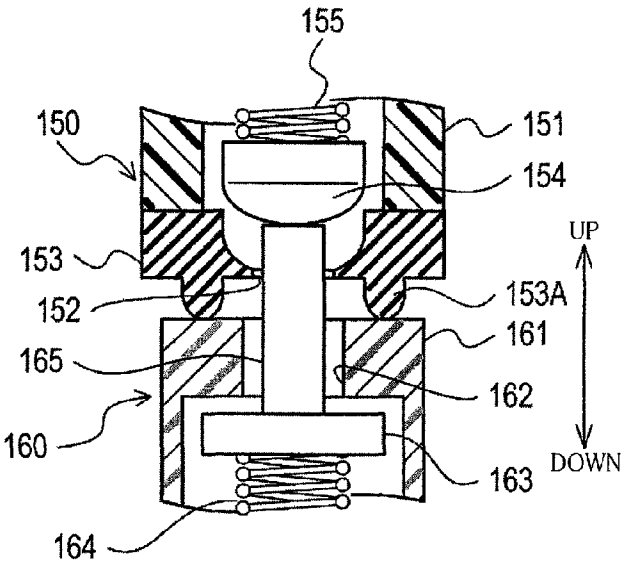
FIG. 4B is a view for explaining the sub-tank-side connecting portion 150 and the main-tank-side connecting portion 160 upon the operation of supplying ink.

The sub-tank-side connecting portion 150 is fixed to the main body of the recording head unit 100 and communicates with the sub tank 121. As shown in FIG. 1B, a valve cap 153 in which a valve opening 152 (in FIGS. 1B and 4B) is formed is fluid-tightly attached to or fitted on one end portion of a generally cylindrical valve housing 151 which is nearer to the main-tank-side connecting portion 160. The valve opening 152 is closed by a displaceable valve member 154 which is disposed in the valve housing 151.

It is noted that the valve cap 153 of this ink-jet printer is formed of an elastic material such as an elastomer. Further, on one end portion of the valve cap 153 which is nearer to the main-tank-side connecting portion 160, there is provided a ring-shaped projecting portion 153A which projects toward the main-tank-side connecting portion 160 so as to surround the valve opening 152.

A coil spring 155 is an elastically pressing means that presses, in a direction in which the valve opening 152 is closed, one of opposite sides of the valve member 154 which is farther from the main-tank-side connecting portion 160. A preset load and a spring constant of the coil spring 155 are set such that a sum of a pressing force F1 that is applied, depending on a pressure of an inside of the valve housing 151, to the valve member 154 in a direction in which the valve member 154 is closed, and a pressing force F2 that is applied to the valve member 154 depending on the coil spring 155 is substantially equal to or slightly larger than a pressing force F3 that is applied, depending on an atmospheric pressure, to the valve member 154 in a direction in which the valve member 154 is opened.

In this ink-jet printer, the sub-tank-side connecting portion 150 communicates with an upper end portion of the inside space of the sub tank 121, and the recording head 110 communicates with a lower portion of the sub tank 121.

Also, the main-tank-side connecting portion 160 is connected to the sub-tank-side connecting portion 150 when the ink is supplied to the sub tank 121, so that the sub tank 121 and the ink cartridge 131 communicate with each other. It is noted that, as shown in FIG. 1A, the main-tank-side connecting portion 160 communicates with the ink cartridge 131 via an ink supply tube or pipe such as a tube 166 or a pipe.

That is, in this ink-jet printer, an ink supply passage (i.e., a liquid supply passage) 168 through which the ink is supplied from the cartridge 131 to the sub tank 121 is formed by the tube 166, the main-tank-side connecting portion 160, and the sub-tank-side connecting portion 150. The ink supply passage 168 is configured to be separable into the tube 166 and the main-tank-side connecting portion 160, and the sub-tank-side connecting portion 150. In other words, the ink supply passage 168 is configured to be separable into a main-tank-side portion and a sub-tank-side portion which respectively communicate with the cartridge 131 and the sub tank 121. That is, the main-tank-side portion includes the tube 166 and the main-tank-side connecting portion 160, and the sub-tank-side portion includes the sub-tank-side connecting portion 150.

As shown in FIG. 1B, a valve opening 162 is formed in one end portion of a generally cylindrical valve housing 161 which is nearer to the valve cap 153. The valve opening 162 is closed by a displaceable valve member 163 which is disposed in the valve housing 161.

A coil spring 164 is an elastic means for applying a pressing force to the valve member 163 in a direction in which the valve opening 162 is closed. A push rod 165 projects toward the sub-tank-side connecting portion 150 so as to open the valve opening 152 by pushing the valve member 154 of the sub-tank-side connecting portion 150. The push rod 165 is integral with the valve member 163, so as to be displaced integrally with the valve member 163.

Also, at a part of the main-tank-side connecting portion 160, that is, at a specific position in the ink supply passage 168, there is provided a second ink detector 200, as a second detector, configured to detect presence and absence of the ink existing at the specific position in the ink supply passage 168 (more specifically, the ink in the main-tank-side connecting portion 160). That is, the second ink detector 200 configured to detect the presence and the absence of the ink in the ink supply passage 168 at one of opposite end parts of the main-tank-side portion which is to be connected to the sub-tank-side portion.

Figure 3:
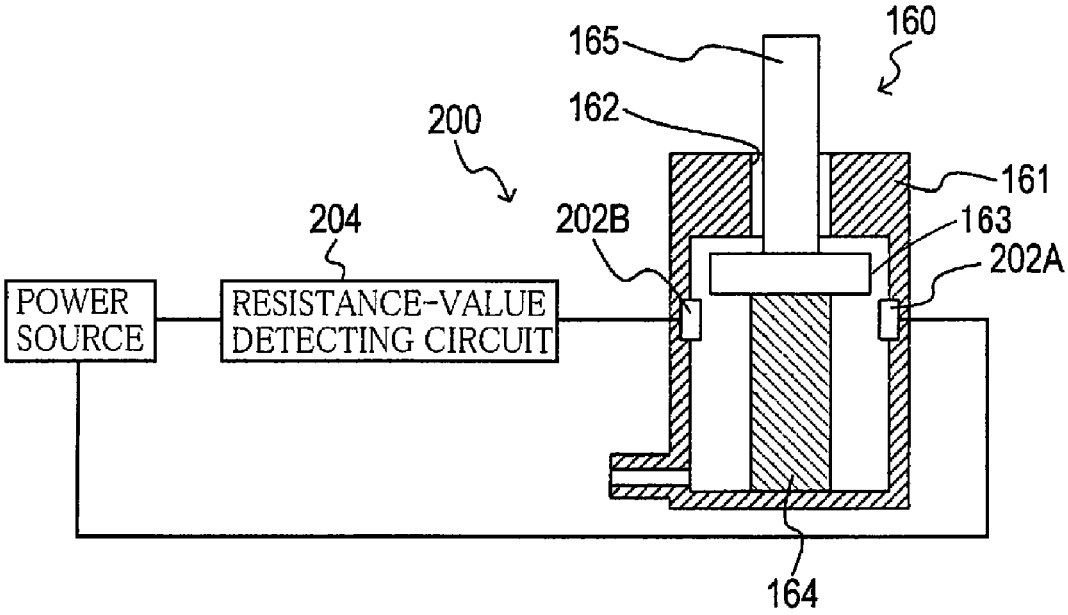
FIG. 3 is a view for explaining a configuration of a second ink detector 200.

As shown in FIG. 3, the second ink detector 200 includes a pair of electrodes 202A, 202B provided at a distal end portion of the main-tank-side connecting portion 160 which is nearer to the valve opening 162, a resistance value detecting-circuit 204 for detecting a value of a resistance between the electrode 202A and the electrode 202B, and so on.

In this ink-jet printer, where the resistance value having been detected by the resistance value detecting-circuit 204 is equal to or smaller than a threshold value, it is judged that the ink is present in the main-tank-side connecting portion 160. On the other hand, where the resistance value having been detected by the resistance value detecting-circuit 204 is larger than the threshold value, it is judged that the ink is absent in the main-tank-side connecting portion 160.

The slide cam 180 has a cam surface 181 which contacts respective longitudinal end portions of the push rod 170 and the main-tank-side connecting portion 160 so as to move the push rod 170 and the main-tank-side connecting portion 160 in a longitudinal direction of each of the push rod 170 and the main-tank-side connecting portion 160 (in this ink-jet printer, in the vertical direction).

Figure 5:
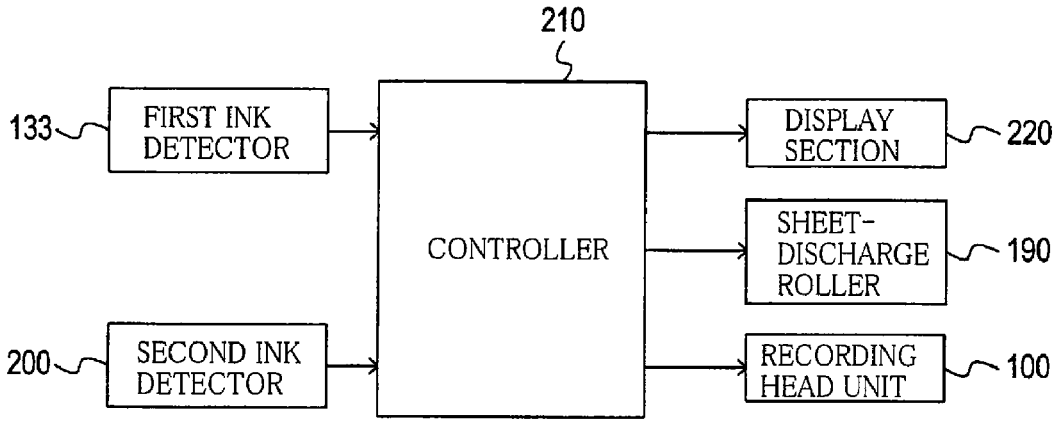
FIG. 5 is a block diagram for explaining an electric configuration of a major part or a feature of an ink-jet printer as the present embodiment.

In this ink-jet printer, when the push rod 170 and the main-tank-side connecting portion 160 are to be moved upward, the slide cam 180 is moved toward the left side in FIG. 1A by a driving force transmitted from the sheet-discharge roller 190 (as shown in FIG. 5) to the slide cam 180 via a driving force transmitting mechanism (not shown).

On the other hand, when the push rod 170 and the main-tank-side connecting portion 160 are to be moved downward, a transfer of the driving force from the sheet-discharge roller 190 is interrupted, so that the slide cam 180 is moved toward the right side in FIG. 1A by an elastic force of a tension spring 182.

3-2. General Explanation of Operation of Ink Supply Mechanism

The ink supply mechanism 140 connects the sub-tank-side connecting portion 150 and the main-tank-side connecting portion 160, that is, connects the main-tank-side portion and the sub-tank-side portion to supply the ink from the ink cartridge 131 to the sub tank 121 when the remaining amount of the ink in the sub tank 121 is equal to or smaller than the threshold amount.

It is noted that, in this ink-jet printer, when an amount of the ink ejected by the recording head 110 or a number of the ejections of the ink by the recording head 110 (including an amount of the ink and a number of the ejections in a purging operation) reaches a certain amount or a certain number after a time at which the ink is last supplied to the sub tank 121, the remaining amount of the ink in the sub tank 121 is estimated to be equal to or smaller than the threshold amount.

Figure 4A:
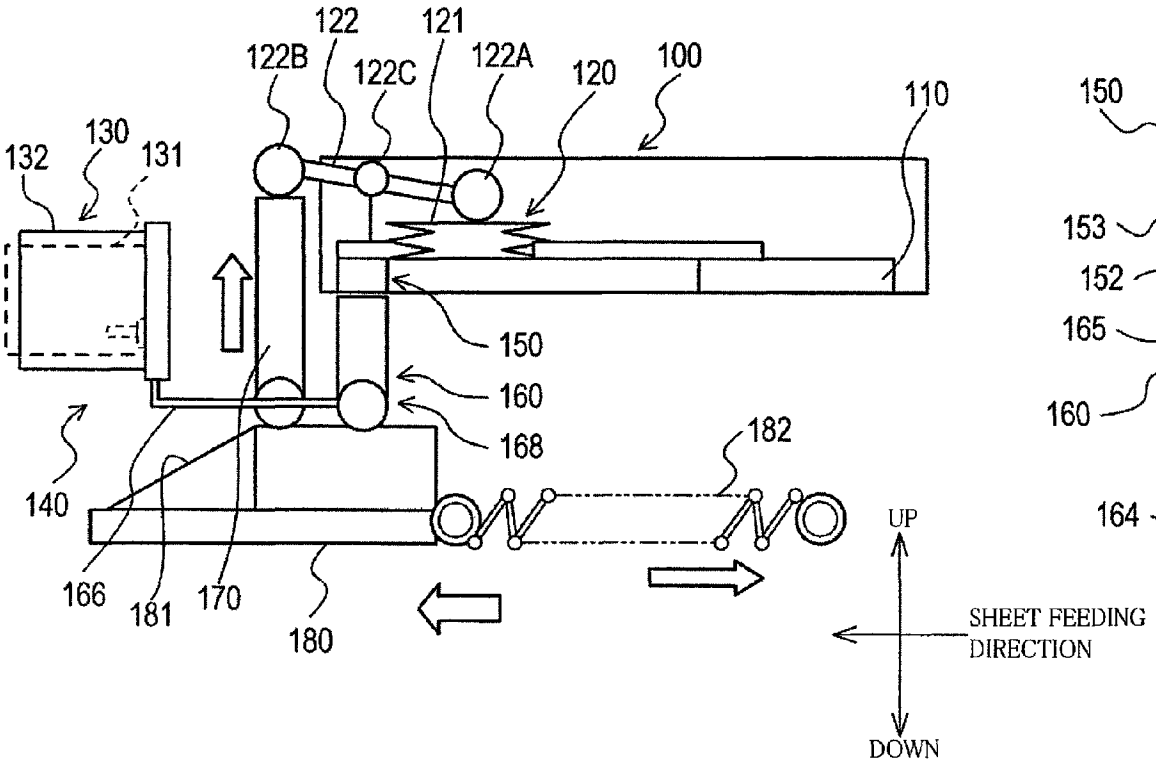
FIG. 4A is a view for explaining the ink supply mechanism when the operation of supplying ink is performed.

When a controller 210 (as shown in FIG. 5) for controlling or performing operations of the ink-jet printer has judged that the remaining amount of the ink in the sub tank 121 is equal to or smaller than the threshold amount, the sheet-discharge roller 190 (as shown in FIG. 5) is rotated, whereby the slide cam 180 is moved toward the left side of the FIG. 4A.

As a result, the push rod 170 and the main-tank-side connecting portion 160 are moved upward by being pushed by the slide cam 180. Thus, the sub-tank-side connecting portion 150 and the main-tank-side connecting portion 160 are connected to each other, whereby the sub tank 121 and the ink cartridge 131 communicate with each other. That is, the ink-jet printer realizes a connected state in which the main-tank-side portion and the sub-tank-side portion are connected to each other.

Meanwhile, a distal end portion of the push rod 170 pushes up the other end 122B of the pressing lever 122. Thus, as shown in FIG. 4A, the one end 122A of the pressing lever 122 is moved downward such that the sub tank 121 is contracted as if crushed. As a result, the ink remaining in the sub tank 121 is temporarily returned to the ink cartridge 131.

Then, when the controller 210 has judged that the contraction of the sub tank 121 is finished, the controller 210 stops the rotation of the sheet-discharge roller 190, whereby the slide cam 180 is moved toward the right side of the FIG. 4A. As a result, the sub tank 121 is extended by its restoration force while the push rod 170 is displaced downward. Thus, the ink in the ink cartridge 131 is supplied to the sub tank 121 by being absorbed by the sub tank 121.

When the slide cam 180 is further moved toward the right side in the figure, the push rod 170 is separated, as shown in FIG. 1, from the pressing lever 122, and the sub-tank-side connecting portion 150 and the main-tank-side connecting portion 160 are disconnected from each other. That is, the ink-jet printer realizes a disconnected state in which the main-tank-side portion and the sub-tank-side portion are disconnected from each other.

In view of the above, the ink-jet printer is configured such that the disconnected state is changed to the connected state when the ink is supplied from the ink cartridge 131 to the sub tank 121.

4. Controller

FIG. 5 is a block diagram for explaining an electric configuration of a major part or a feature of this ink-jet printer. As shown in FIG. 5, the controller 210 controls this ink-jet printer. The controller 210 is constituted by a microcomputer including a CPU, a RAM, a ROM, and so on.

When the ink is supplied from the ink cartridge 131 to the sub tank 120, the controller 210 recognizes a remaining amount of the ink in the ink cartridge 131 on the basis of a result of the detections of the first ink detector 133 and the second ink detector 200. Then, the controller 210 commands a display section 220 for displaying various information, to display a result of the recognition of the remaining amount of the ink.

5. Featured Operations of this Ink-Jet Printer

Figure 6:
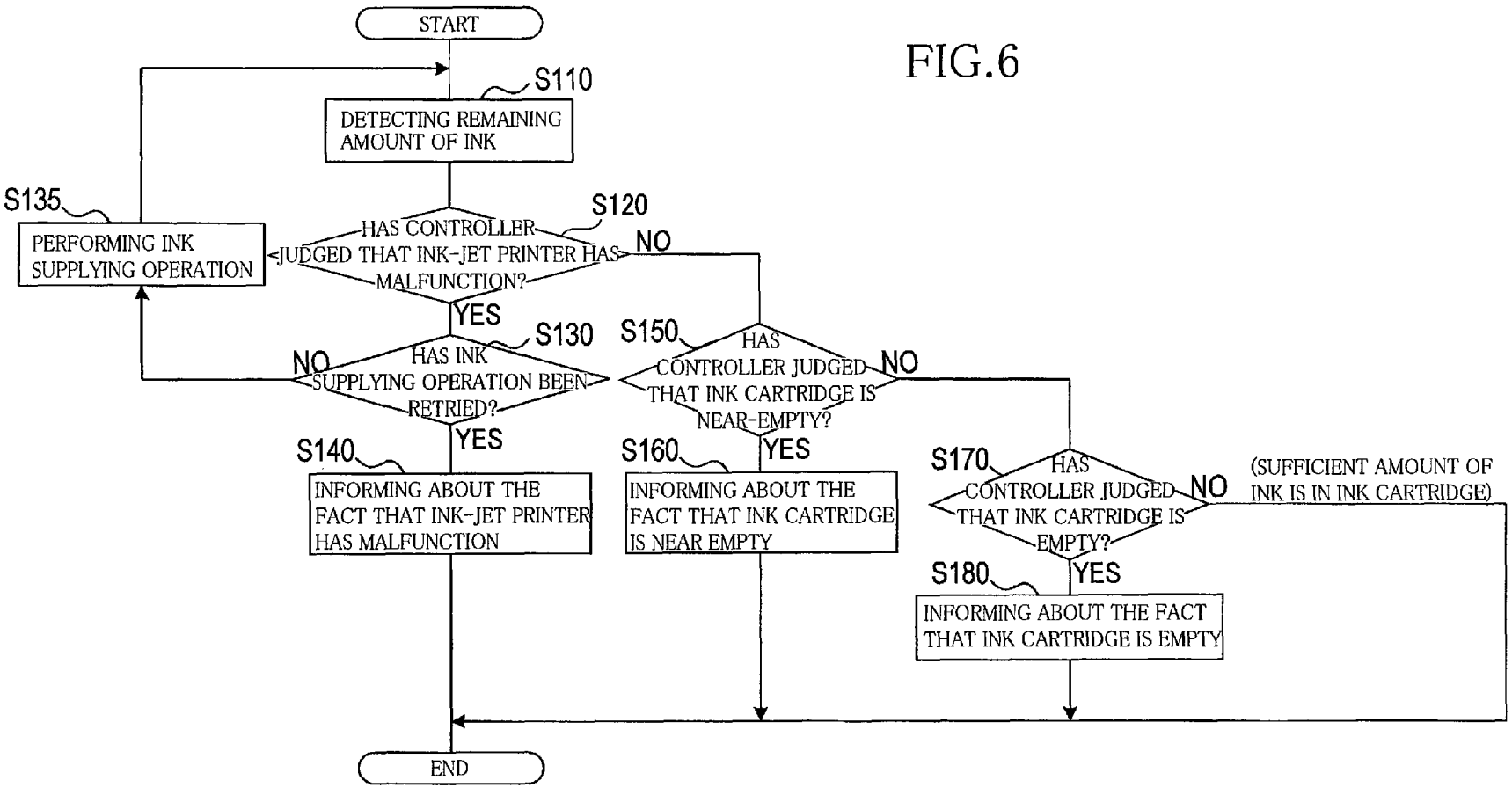
FIG. 6 is a flow-chart showing a remaining ink amount judging processing performed by a CPU of a controller 210 when the ink-jet printer is performing the operation of supplying ink.

FIG. 6 is a flow-chart showing a remaining ink amount judging processing performed by the CPU of the controller 210 when the ink-jet printer is performing an ink supplying operation for supplying the ink from the ink cartridge 131 to the sub tank 121. In this remaining ink amount judging processing, initially, in S110, the result of the detections of the first ink detector 133 and the second ink detector 200 is obtained, and the remaining amount of the ink in the ink cartridge 131 is judged or recognized on the basis of the result of the detections.

Here, FIG. 7 is a judging table for explaining a criterion in which the controller 210 recognizes the remaining amount of the ink in the ink cartridge 131 on the basis of the result of the detections of the first ink detector 133 and the second ink detector 200.

As shown in FIGS. 6 and 7, in S110, where the presence of the ink in the ink cartridge 131 (i.e., the main tank) is detected by the first ink detector 133, and the presence of the ink in the ink supply passage 168 is detected by the second ink detector 200, the controller 210 judges that the sufficient amount of the ink is in the ink cartridge 131.

Where the presence of the ink in the ink cartridge 131 is detected by the first ink detector 133, and the absence of the ink in the ink supply passage 168 is detected by the second ink detector 200, the controller 210 judges that the ink-jet printer has a malfunction or an error. That is, the controller 210 can be considered to include an error judging section configured to judge that the ink-jet printer has the malfunction where the presence of the ink in the ink cartridge 131 is detected by the first ink detector 133, and the absence of the ink in the ink supply passage 168 is detected by the second ink detector 200.

Where the absence of the ink in the ink cartridge 131 is detected by the first ink detector 133, and the presence of the ink in the ink supply passage 168 is detected by the second ink detector 200, the controller 210 judges that the remaining amount of the ink in the ink cartridge 131 is relatively small, that is, the ink cartridge 131 is in the near-empty state.

Where the absence of the ink in the ink cartridge 131 is detected by the first ink detector 133, and the absence of the ink in the ink supply passage 168 is detected by the second ink detector 200, that is, where the presence of the ink is detected by neither the first ink detector 133 nor the second ink detector 200, the controller 210 judges that no ink is in the ink cartridge 131, that is, the ink cartridge 131 is empty. That is, the controller 210 can be considered to include an empty judging section which judges that the ink cartridge 131 (i.e., the main tank) is empty of the ink where the absence of the ink in the ink cartridge 131 is detected by the first ink detector 133 and the absence of the ink in the ink supply passage 168 is detected by the second ink detector 200.

As shown in FIG. 6, where the controller 210 has judged that the ink-jet printer has the malfunction or the error on the basis of the result of the recognition of the remaining amount of the ink in the ink cartridge 131 in S110 (S120: YES), the controller 210 judges in S130 whether the ink supplying operation has been performed again or retried during the remaining ink amount judging processing.

Where the controller 210 has judged in S130 that the ink supplying operation has not been retried (S130: NO), the sheet-discharge roller 190 is controlled, in S135, to be rotated, whereby the ink supplying operation is performed. Then, the remaining ink amount judging processing returns to S110. That is, the controller 210 can be considered to include a supplying section configured to perform the ink supplying operation for controlling the ink supply mechanism 140 of this ink-jet printer to supply the ink from the ink cartridge 131 to the sub tank 121 where the error judging section has judged that this ink-jet printer has the malfunction.

On the other hand, where the controller 210 has judged in S130 that the ink supplying operation has been retried (S130: YES), a fact that the ink-jet printer has the malfunction is displayed, in S140, on the display section 220. Then, this remaining ink amount judging processing is completed. That is, the controller 210 can be considered to include an informing section configured to perform an informing operation for informing a user about the fact that the ink-jet printer has the malfunction, on the basis of a result of the judgment of the error judging section after the supplying operation is performed a predetermined number of times. In this ink-jet printer, the predetermined number is one.

Where the controller 210 has judged that the ink-jet printer has no malfunction on the basis of the result of the recognition of the remaining amount of the ink in the ink cartridge 131 in S110 (S120: NO), the controller 210 judges, on the basis of the result of the recognition in S110, whether the ink cartridge 131 is in the near-empty state in S150. Where the controller 210 has judged that the ink cartridge 131 is in the near-empty state (S150: YES), a fact that the ink cartridge 131 is in the near-empty state is displayed in S160 on the display section 220. Then, this remaining ink amount judging processing is completed. On the other hand, where the controller 210 has judged that the ink cartridge 131 is not in the near-empty state (S150: NO), the controller 210 judges, on the basis of the result of the recognition in S110, whether the ink cartridge 131 is empty in S170.

Where the controller 210 has judged that the ink cartridge 131 is empty (S170: YES), a message for prompting the user to replace the ink cartridge 131 is displayed in S180 on the display section 220. Then, this remaining ink amount judging processing is completed.

On the other hand, where the controller 210 has judged that the ink cartridge 131 is not empty (S170: NO), the controller 210 judges that the sufficient amount of the ink is in the cartridge 131. Then, this remaining ink amount judging processing is completed.

6. Features of this Ink-Jet Printer

In this ink-jet printer, the first ink detector 133 and the second ink detector 200 are disposed, in series, on a path extending from the ink cartridge 131 to the ink supply passage 168. Further, the controller 210 judges whether the ink cartridge 131 is empty of the ink on the basis of the result (i.e., measured values) of the detections of the first ink detector 133 and the second ink detector 200.

Thus, according to this ink-jet printer, when compared to a conventional ink-jet printer in which the empty is judged on the basis of a measured value which is detected by one sensor and a calculated value calculated after the measured value is detected by the one sensor, the presence and the absence of the ink in the ink cartridge 131 can be more precisely detected because more measured values are used to judge the ink cartridge 131 is empty. Thus, the ink in the ink cartridge 131 can be almost completely used up.

Meanwhile, where the presence of the ink in the ink cartridge 131 is detected by the first ink detector 133, and the absence of the ink in the ink supply passage 168 (more specifically, the main-tank-side connecting portion 160) is detected by the second ink detector 200 (S120: Yes, in FIG. 6), the ink-jet printer may have the malfunction relating to an ink supplying function. Here, the terms "the malfunction relating to the ink supplying function" include a malfunction relating to the ink supply mechanism 140. More specifically, the terms "the malfunction relating to the ink supplying function" mean any malfunction which has a risk adversely affecting the ink supplying operation of the ink-jet printer. For example, the ink is not supplied to the sub tank 121 even though the sufficient amount of the ink is in the ink cartridge 131. More specifically, it can be expected that the ink cartridge 131 and the sub tank 121 are not correctly connected to each other via the ink supply passage 168. Further, the malfunction may include a case that the ink detecting sensor 137 is faulty.

Thus, in this ink-jet printer, where the presence of the ink in the ink cartridge 131 is detected by the first ink detector 133, and the absence of the ink in the ink supply passage 168 is detected by the second ink detector 200, the controller 210 judges that the ink-jet printer has the malfunction and informs the user about the fact (S140 in FIG. 6). As a result, the user can know the fact that the ink-jet printer has the malfunction when the fact is displayed on the display section 220.

Further, in this ink-jet printer, the ink supplying operation is retried where the controller 210 has judged that the ink-jet printer has the malfunction in S120 shown in FIG. 6. Thus, where the malfunction has been eliminated or overcome by this ink supplying operation, this malfunction may be considered to relate to the ink supplying operation which has been performed before the retried ink supplying operation and in which the ink is supplied from the ink cartridge 131 to the sub tank 121. On the other hand, where the malfunction is not eliminated even though the ink supplying operation has been retried (S130: NO), the malfunction may be considered to relate to the ink-jet printer itself other than the ink supplying operation, for example.

As described above, this ink-jet printer is of the station supply type, and is configured such that when the ink supplying operation is performed, the ink remaining in the sub tank 121 is temporarily returned to the ink cartridge 131. Thus, air in the ink supply passage 168 can be discharged.

Consequently, even when the ink supplying operation is performed after the ink cartridge 131 is replaced, the remaining ink in the ink supply passage 168 and the sub tank 121 can be effectively used without being discarded. Further, in this ink-jet printer, the second ink detector 200 is provided at the distal end portion of the main-tank-side connecting portion 160 which is nearer to the valve opening 162. Thus, the remaining amount of the ink in the ink cartridge 131 can be suitably recognized.

7. Other Embodiments

The first ink detector 133 of the above-described embodiment may have any configuration as long as the first ink detector 133 can detect the ink in the ink cartridge 131. For example, the first ink detector 133 may have the same configuration as the second ink detector 200. Similarly, the second ink detector 200 of the above-described embodiment may have any configuration as long as the second ink detector 200 can detect the ink in the ink supply passage 168.

Further, the second ink detector 200 of the above-described embodiment may be disposed at any position as long as the second ink detector 200 is disposed downstream of a position at which the first ink detector 133 is disposed, in a direction in which the ink is supplied. For example, the second ink detector 200 may be disposed at a portion of the tube 166, or may be disposed at a part of the sub-tank-side connecting portion 150, that is, may be disposed at a part of the sub-tank-side portion.

Furthermore, for example, where a second sub tank is provided at a portion of the ink supply passage 168 which is located between the sub tank 121 and the ink cartridge 131, the second ink detector 200 may be disposed at a portion of a passage connecting the second sub tank and the sub tank 121 and may be disposed at a portion of a passage connecting the second sub tank and the ink cartridge 131.

Also, in the above-described embodiment, the user is informed about the remaining amount of the ink in the ink cartridge 131 by the display section 220 provided in the ink-jet printer, but the present invention is not limited to this configuration. That is, the ink-jet printer may be configured such that the user is informed about the remaining amount of the ink in the ink cartridge 131 by a terminal device connected to the ink-jet printer.

Further, the ink-jet printer as the above-described embodiment is applied to the ink-jet printer of the station supply type, but may be also applied to an ink-jet printer of a tube supply type in which the ink cartridge 131 and the sub tank 121 are always connected to each other via a tube. That is, the second ink detector 200 needs only to be provided at a portion of the tube via which the ink cartridge 131 and the sub tank 121 are always connected, on the downstream side of the first ink detector 133 in the direction in which the ink is supplied from the ink cartridge 131 to the sub tank 121.

It is to be understood that the present invention is not limited to the details of the illustrated embodiments, but may be embodied with various changes and modifications, which may occur to those skilled in the art, without departing from the spirit and scope of the invention.

What is claimed is:

1. A liquid-droplet ejecting apparatus, comprising:

a main tank which stores liquid;

a head unit including a sub tank which accommodates the liquid supplied from the main tank, and an ejecting head which ejects droplets of the liquid supplied from the sub tank;

a liquid supply passage communicating, at one end thereof, with the main tank and communicating, at the other end thereof, with the sub tank such that the liquid is supplied from the main tank to the sub tank through the liquid supply passage;

a first detector configured to detect presence and absence of the liquid stored in the main tank;

a second detector configured to detect presence and absence of the liquid in the liquid supply passage; and a controller configured to perform various operations for the liquid-droplet ejecting apparatus and including an empty judging section which judges that the main tank is empty of the liquid where the absence of the liquid in the main tank is detected by the first detector and the absence of the liquid in the liquid supply passage is detected by the second detector.

2. The liquid-droplet ejecting apparatus according to claim 1, wherein the second detector is configured to detect, at a specific position in the liquid supply passage, whether the liquid is present or absent in the liquid supply passage.

3. The liquid-droplet ejecting apparatus according to claim 1, wherein the controller includes an error judging section configured to judge that the liquid-droplet ejecting apparatus has a malfunction where the presence of the liquid in the main tank is detected by the first detector and the absence of the liquid in the liquid supply passage is detected by the second detector.

4. The liquid-droplet ejecting apparatus according to claim 3, wherein the error judging section is configured to judge that the liquid-droplet ejecting apparatus has the malfunction relating to a liquid supplying function of the liquid-droplet ejecting apparatus where the presence of the liquid in the main tank is detected by the first detector and the absence of the liquid in the liquid supply passage is detected by the second detector.

5. The liquid-droplet ejecting apparatus according to claim 3, wherein the controller includes an informing section configured to perform an informing operation for informing a user about a fact that the liquid-droplet ejecting apparatus has the malfunction, on the basis of a result of the judgment of the error judging section.

6. The liquid-droplet ejecting apparatus according to claim 3, wherein the controller includes a supplying section configured to perform a supplying operation for supplying the liquid from the main tank to the sub tank where the error judging section has judged that the liquid-droplet ejecting apparatus has the malfunction.

7. The liquid-droplet ejecting apparatus according to claim 6, wherein the supplying section is configured to perform the supplying operation for controlling a liquid supplying mechanism of the liquid-droplet ejecting apparatus to supply the liquid from the main tank to the sub tank, where the error judging section has judged that the liquid-droplet ejecting apparatus has the malfunction.

8. The liquid-droplet ejecting apparatus according to claim 6, wherein the controller includes an informing section configured to perform an informing operation for informing a user about a fact that the liquid-droplet ejecting apparatus has the malfunction, on the basis of a result of the judgment of the error judging section after the supplying operation is performed a predetermined number of times.

9. The liquid-droplet ejecting apparatus according to claim 1, wherein the liquid supply passage is configured to be separable into a main-tank-side portion and a sub-tank-side portion which respectively communicate with the main tank and the sub tank.

10. The liquid-droplet ejecting apparatus according to claim 9, wherein the second detector configured to detect the presence and the absence of the liquid in the liquid supply passage at one of opposite end parts of the main-tank-side portion which is to be connected to the sub-tank-side portion.

11. The liquid-droplet ejecting apparatus according to claim 9, configured to selectively realize a connected state in which the main-tank-side portion and the sub-tank-side portion are connected to each other and a disconnected state in which the main-tank-side portion and the sub-tank-side portion are disconnected from each other.

12. The liquid-droplet ejecting apparatus according to claim 11, configured such that the disconnected state is changed to the connected state when the liquid is supplied from the main tank to the sub tank.

* * * * *